US005260757A

United States Patent [19]

Frank et al.

[11] Patent Number: 5,260,757

[45] Date of Patent: Nov. 9, 1993

[54] ELECTROSTATOGRAPHIC REPRODUCING MACHINE

[75] Inventors: Nicholas Frank, London; Carl R. Chapman, Byfleet, both of United Kingdom

[73] Assignee: Xerox Corporation, Stamford, Conn.

[21] Appl. No.: 938,746

[22] Filed: Sep. 2, 1992

[30] Foreign Application Priority Data

Sep. 11, 1991 [GB] United Kingdom ..... 9119486

[51] Int. Cl.[5] ..... G03G 21/00

[52] U.S. Cl. ..... 355/317; 271/242; 271/270

[58] Field of Search ..... 355/317; 271/226, 229, 271/242, 270

[56] References Cited

U.S. PATENT DOCUMENTS

| | | | |
|---|---|---|---|
| 3,888,579 | 6/1975 | Rodek et al. | 355/317 |
| 4,017,167 | 4/1977 | Mitchell | 352/194 |
| 4,645,195 | 2/1987 | Scranton et al. | 271/246 |
| 4,669,853 | 6/1987 | Sosinski et al. | 271/188 X |
| 4,831,407 | 5/1989 | Howard et al. | 355/219 X |
| 4,951,095 | 8/1990 | Warden | 355/273 |
| 4,986,526 | 1/1991 | Dastin | 271/277 X |
| 5,119,146 | 6/1992 | Nobumori et al. | 355/317 |

FOREIGN PATENT DOCUMENTS

| | | | |
|---|---|---|---|
| 57-092347 | 6/1982 | Japan | 355/317 |
| 60-100156 | 6/1985 | Japan | 355/317 |

OTHER PUBLICATIONS

Vol. 11, No. 42 (P-545)[2489] Patent Abstracts of Japan, Feb. 6, 1987.

*Primary Examiner*—Benjamin R. Fuller
*Assistant Examiner*—J. E. Barlow, Jr.

[57] ABSTRACT

A laser printer has a circulating photoreceptor belt 20 and a transfer station 4 at which toner images are transferred from the belt to copy sheets. Each copy sheet is registered, upstream of the transfer station 4, in the nip of registration rolls 12 before being fed to the transfer station. The copy sheet is fed to the registration rolls 12 (which at that time are stationary) by feed rolls 13, 14 which continue to rotate so that a buckle is formed in the sheet to assist in removing any de-skew. When the sheet has been registered, the registration rolls 12 are rotated and, initially, are accelerated to a speed about 20% greater than the normal operating speed. That has the effect of decreasing the amount of buckle in the sheet before the trail end of the sheet reaches the registration rolls. When the buckle has been reduced, the speed of the rolls is reduced to the normal operating level, which is typically about the same as the speed of the photoreceptor belt.

8 Claims, 3 Drawing Sheets

ELECTROSTATOGRAPHIC REPRODUCING MACHINE

Hereby cross-referenced, and incorporated herein by reference, is the copending application of the same assignee, U.S. Ser. No. 07/939,762, entitled "ELECTROSTATOGRAPHIC REPRODUCING MACHINE", by Peter R. Watson, filed Sep. 2, 1992.

The present invention relates to electrostatographic reproducing machines and, in particular, to the feeding and registration of copy sheets in such machines.

In electrostatographic copiers/printers, it is often desirable to introduce a certain amount of buckle into copy sheets, particularly at copy sheet registration stations. The buckle is introduced to assist in de-skewing the sheets and ensure that they are properly registered. For example, when a developed toner image is transferred from a circulating imaging member (for example a photoreceptor belt) to a copy sheet, it is known to register the latter at a location upstream of the image transfer station to ensure that the image will be correctly positioned on the sheet. A small buckle may be introduced into the copy sheet as it is being registered, to reduce skew and misalignment.

U.S. Pat. No. 4,669,853 describes a xerographic printing machine in which copy sheets are registered at registration rolls upstream of the image transfer station. When a copy sheet is first fed to the registration rolls, the latter are braked and, by continuing to drive the copy sheet into the rolls, a buckle is introduced into the sheet, which serves to de-skew the sheet and ensure that the sheet is properly registered at the registration nip. Thereafter, the registration rolls are brought into operation and the sheet is driven through the rolls towards the transfer station.

A similar arrangement is described in EP-A-0 207 425 but, in that case, copy sheets are registered at a gate upstream of the transfer station.

It is also known to introduce a buckle into a copy sheet just before the image transfer station, with a view to reducing image smear at the transfer station. EP-A-0 324 544 describes an arrangement of that type, in which the rolls that feed a copy sheet to the transfer station are driven at a faster speed for a short interval once the sheet has contacted the photoreceptor, to generate a buckle in the sheet just before the transfer region. The speed of the feed rolls is then returned to its initial value so that the buckle size remains constant while the remainder of the sheet is fed.

In addition, it is known to reduce slippage of a copy sheet at an image transfer station by varying the speed of rollers that transport a copy sheet away from the transfer station. An arrangement of that type is referred to in Volume 11, No. 42 (P-545)[2489] of the Patent Abstracts of Japan, Feb. 6, 1987 and also in U.S. Pat. No. 4,017,167. In the former arrangement, the transport rollers are driven at a higher speed than the imaging member while, in the latter arrangement, a buckle is allowed to form in a copy sheet downstream of the image transfer station.

The present invention is concerned with the problem of damage to copy sheets which have been deliberately buckled during passage through an electrostatographic reproducing machine, for example while being registered upstream of an image transfer station as described above. It has been found that the trail end of certain copy sheets, particularly heavier-weight sheets and labels, can become creased or otherwise damaged if the sheets are deliberately buckled during passage through a xerographic reproducing machine (for example, at registration rolls) and that, in turn, can result in image deletions on the copy sheets if the damage occurs upstream of the image transfer station. It is an object of the invention to enable that damage to be prevented.

The present invention provides an electrostatographic reproducing machine comprising a circulating imaging member; a transfer station at which a developed toner image may be transferred from the imaging member to a copy sheet; a copy sheet path along which copy sheets may be fed through the machine to receive a developed toner image at the transfer station; registration rolls which are located in the copy sheet path and which remain stationary while a copy sheet is received in the nip of the rolls and a buckle forms in the copy sheet; and means for driving the registration rolls to feed a copy sheet along the sheet path, the driving means being operable, when a copy sheet is registered in the nip of the registration rolls, initially to raise the speed of the rolls sufficiently to reduce the buckle in the sheet and then to reduce the speed to continue feeding the sheet along the copy sheet path.

The registration rolls may be positioned to feed copy sheets to the transfer station. In that case, the reduced speed of the rolls may be approximately equal to that of the imaging member.

Preferably, the buckle-reducing speed of the rolls is about 20% greater than the reduced speed. Typically, the rolls are run at the buckle-reducing speed to reduce the buckle in the copy sheet by about one quarter.

The length of time for which the rolls are run at the buckle-reducing speed may be adjustable to enable the amount of buckle that is removed from the sheet to be varied.

The term "copy sheet" includes sheets of various materials and thicknesses, for example heavy weight papers and labels.

The present invention also provides a method of producing copies using an electrostatographic reproducing machine comprising a circulating imaging member; a transfer station at which a developed toner image may be transferred from the imaging member to a copy sheet; a copy sheet path along which copy sheets may be fed through the machine to receive a developed toner image at the transfer station; and registration rolls which are located in the copy sheet path, the method comprising the steps of: maintaining the registration rolls stationary while a copy sheet is received in the nip of the rolls and a buckle forms in the copy sheet and, when the copy sheet is registered in the nip of the registration rolls, raising the speed of the rolls sufficiently to reduce the buckle in the sheet and then reducing the speed to continue feeding the sheet along the copy sheet path.

By way of example only, an embodiment of the invention will be described with reference to the accompanying drawings, in which.

Figure 1:
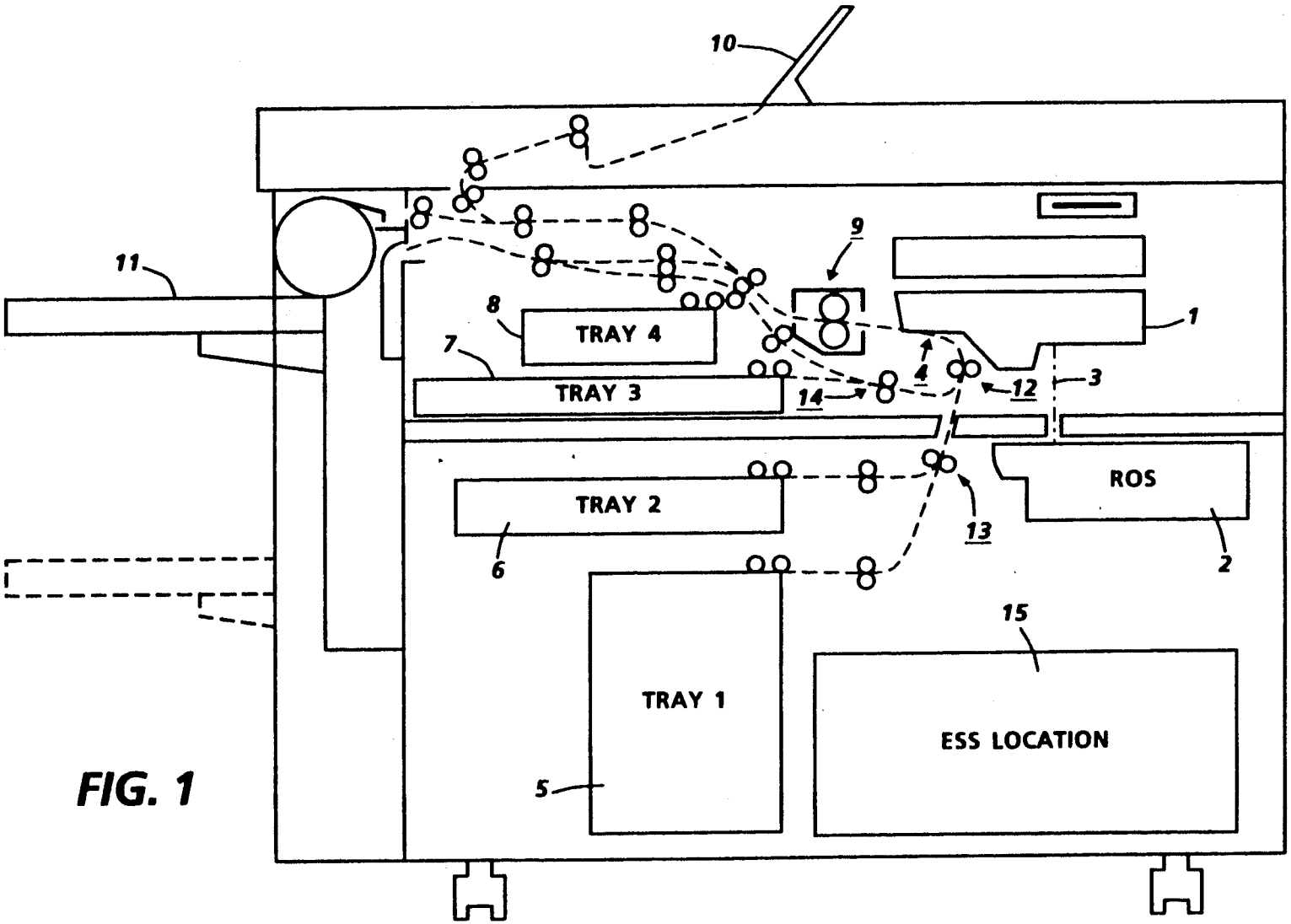
FIG. 1 is a diagrammatic view of an electrostatographic printing machine embodying the invention.
Figures 3A, 3B, 4A, 4B:
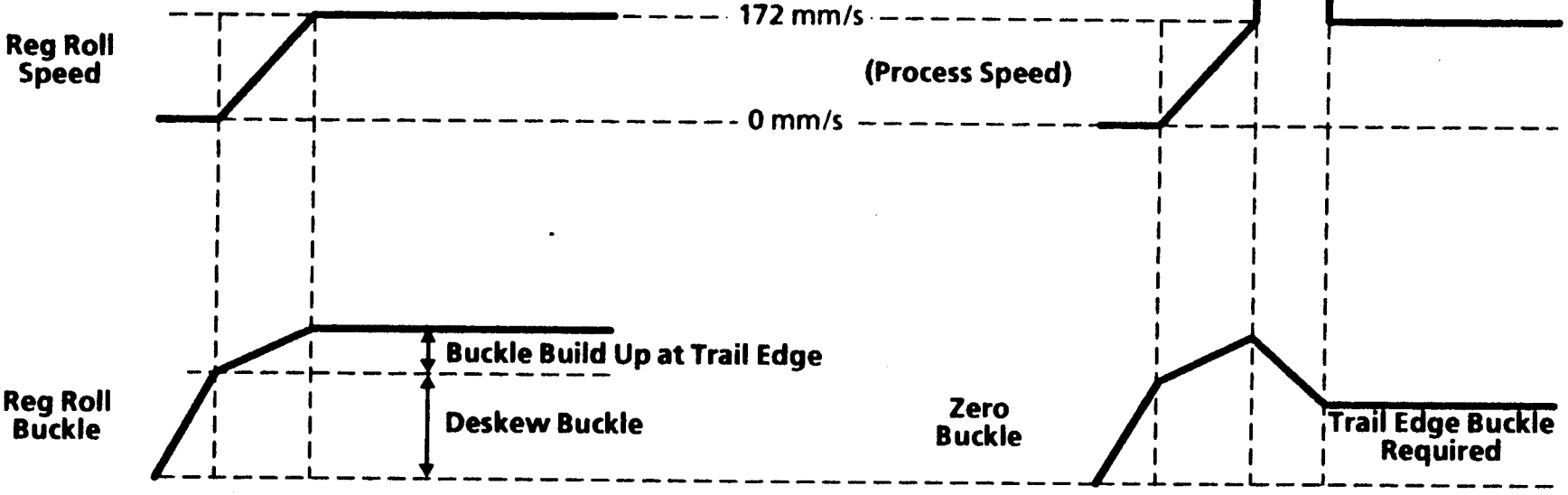
FIG. 3A (Prior Art)

FIGS. 3*a* and 3*b* illustrate the variation in speed, with time, of registration rolls in a prior art machine and the machine shown in FIG. 1, and FIGS. 4*a* and 4*b* illustrate the variation, with time, in the amount of buckle introduced into a sheet in a prior art machine and in the machine shown in FIG. 1.

Figure 2:
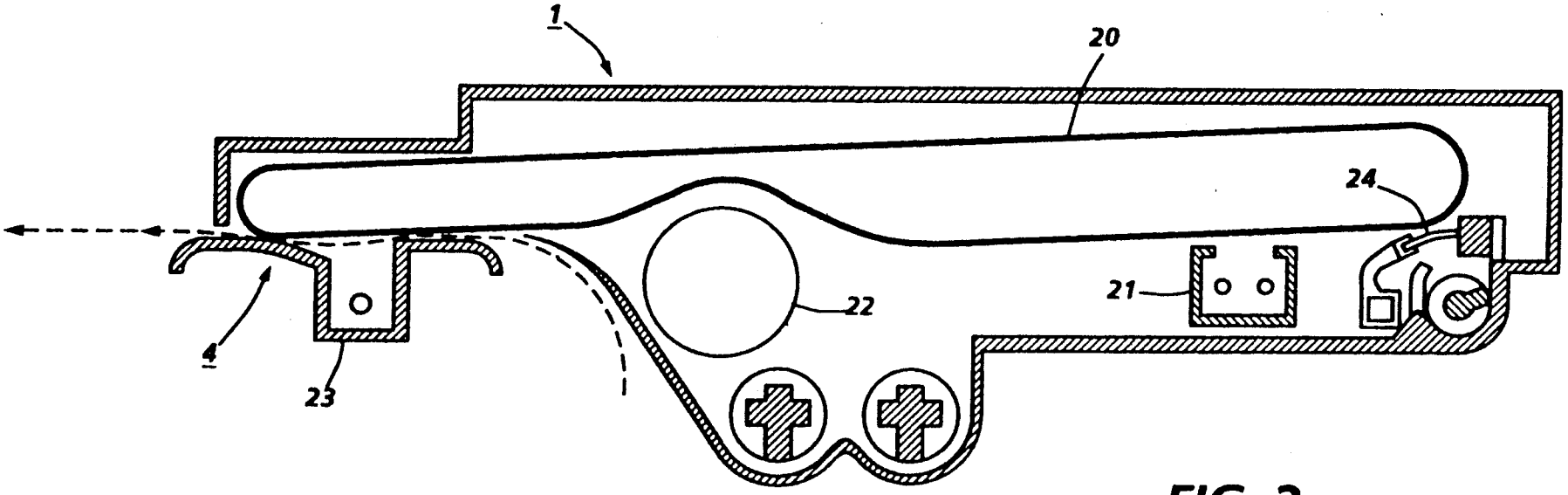
FIG. 2 is a schematic cross-section of a replaceable cassette which forms part of the machine shown in FIG. 1.

FIG. 1 shows a laser printer employing a replaceable xerographic cassette 1 which is shown in greater detail in FIG. 2. A xerographic imaging member in the form of an endless flexible photoreceptor belt 20 is housed within the cassette 1, together with other xerographic process means as described below. A raster output scanner (ROS) 2 provides an imaging beam 3 which is directed at the photoreceptor belt 20 through an imaging slit in the cassette 1 to form an electrostatic latent image on the belt. The image is developed within the cassette and is transferred, at a transfer station 4, to a copy sheet which is fed to that location from one of four supply trays 5, 6, 7 and 8. The copy sheet supply tray 5 is a high capacity feeder and the other trays 6, 7 and 8 can contain copy sheets of different sizes. The transferred image is fused to the copy sheet at a fusing station 9 and the copy sheet may then be delivered from the printer to be collected either in a sample tray 10 on top of the machine or in a stacking tray 11 on the side of the machine. However, the machine also has a trayless duplex path so that a copy sheet with a fused image on one side may, alternatively, be returned to the transfer station 4 to receive an image on the other side before being delivered from the machine into one of the trays 10, 11.

The cassette 1 may be similar to that described in U.S. Pat. No. 4,831,407. In addition to the photoreceptor belt 20, it includes a charge corotron 21; a developer device 22; a transfer corotron 23 and a cleaning device 24. The charge corotron 21 is located upstream of the imaging slit in the cassette to deposit a uniform electrostatic charge on the surface of the belt before it is exposed to the imaging beam 3. The developer device 22 is located downstream of the imaging slit to bring developer mixture into proximity with, and thereby develop, the electrostatic latent image on the belt, and the transfer corotron 23 is located at the transfer station 4 to assist in transferring the developed image from the belt to the copy sheet which enters the cassette at that point. Finally, the cleaning device 24 removes any residual toner particles from the surface of the photoreceptor belt which is then illuminated by a discharge lamp to remove any electrostatic charge remaining on the belt.

The cassette 1, as already mentioned, is removable from the printer and can be replaced by another cassette if any of the process elements begins to deteriorate. Alternatively, it can be replaced by a cassette which contains toner of a different color.

The raster output scanner 2 incorporates a He-Ne laser to generate the imaging beam 3, a conventional rotating polygon device to sweep the beam across the surface of the photoreceptor belt, and an acoustic modulator. The beam is modulated in accordance with input signals received from a remote source, for example a user interface and keyboard (not shown). The operation of a raster output scanner of that type to generate a latent image on a photoreceptor belt is well understood and need not be described here. The processing of the image signals from the remote source is handled by an electronic sub-system of the printer, indicated at 15, while operation of the printer generally is under the control of a conventional machine control unit (not shown).

Copy sheets from any of the supply trays 5, 6, 7 and 8 are fed to the transfer station 4 via registration rolls 12, the copy sheet paths being indicated by the broken lines in FIGS. 1 and 2. Sheets from the lowermost trays 5, 6 are fed to the registration rolls by feed rolls 13 (common to both of the lowermost trays) while sheets from the uppermost trays 7, 8 are fed to the registration rolls by feed rolls 14 (common to both of the uppermost trays). The registration rolls 12 are driven by a conventional variable speed stepper motor (not shown) via a conventional clutch (also not shown) which, when the leading edge of a copy sheet arrives at the nip of the registration rolls, is disengaged so that the rolls are stationary. Operation of the stepper motor is regulated by the machine controller. The leading edge of the copy sheet is, accordingly, held at the registration rolls but the feed rolls 13 or 14 continue to rotate with the result that a buckle forms in the sheet upstream of the registration rolls 12. That buckle assists in deskewing the copy sheet and ensures that the sheet is accurately registered at the rolls 12 before the latter are reconnected to the drive motor to feed the copy sheet to the transfer station 4. However, although the buckle serves a useful purpose it has been found that it can cause creases to form in the trail end of a copy sheet, particularly a heavier-weight copy sheet or a sheet of adhesive labels, as the trail edge passes through the rolls 12. If a sheet is creased when it is fed to the transfer station 4, an image may be imperfectly transferred from the photoreceptor belt to the copy sheet.

To reduce the possibility of damage to the trail edge of a copy sheet, the stepper motor that drives the registration rolls 12 is operated by the machine controller to bring the rolls to a normal operating speed, once the copy sheet has been registered, and then to increase the speed still further for a short period of time before returning the speed once again to its normal operating level. The feed rolls 13, 14 continue to run at the same, constant, speed so that the result is a reduction in the amount of buckle in the copy sheet and a consequent reduction in damage to the trail edge of the sheet as it passes through the feed rolls. The buckle in the sheet has, of course, served its purpose by the time that the registration rolls 12 begin to rotate.

FIGS. 3*a* and 3*b* illustrate the manner in which the speed of the registration rolls 12 is varied once the rolls begin to rotate. FIG. 3*a* shows the speed variation in a conventional printer and FIG. 3*b* shows the speed variation in the printer of FIG. 1. In both cases, after a copy sheet has been registered in the stationary rolls, the speed of the rolls is increased to a normal operating speed which is approximately equal to that of the photoreceptor belt 20. In the conventional printer, the speed then remains at the level but in the printer shown in FIG. 1 the speed is then increased rapidly (typically to a speed about 20% faster than the normal operating speed) for a short period of time and is then returned to the normal operating speed. Typically, the increase in speed over the normal operating level is of about 30 ms duration and is sufficient to remove about 2 mm from the buckle (which is typically about 8 mm long) that has been formed in the copy sheet between the registration rolls and the transfer station. In a conventional copier, on the other hand, there will be a further increase in the amount of buckle in the copy sheet (although at a lower rate) while the registration rolls 12 accelerate to the normal operating speed. The variation in the amount of buckle at the trail edge of a copy sheet is illustrated in FIG. 4*a* for a conventional printer and in FIG. 4*b* for a printer of the type shown in FIG. 1. As shown in FIG. 4*a*, the buckle in the copy sheet builds up while the registration rolls 12 are stationary and it is during this period that the sheet is registered in the nip of the registration rolls and any skew in the sheet is removed. When the rolls 12 begin to rotate, the buckle continues to increase (although at a lower rate) and then remains constant when the rolls 12 reach the normal operating speed. It is during this stage that damage to the trail edge of the copy sheet can occur as it passes through the feed rolls. In the printer shown in FIG. 1, on the other hand, the buckle in the copy sheet is reduced during the period for which the speed of the rolls is greater than the normal operating speed and then remains constant at that reduced level, as shown in FIG. 4*b*.

The increase in speed described above can be applied without detriment to ordinary-weight copy sheets as well as to heavier-weight sheets and can, accordingly, be part of the normal operating routine of the copier. In certain circumstances, and depending on the nature of the copy sheets, the time for which the rolls 12 are run at the increased speed can be adjusted to vary the amount of buckle removed from the copy sheets as they are fed through the rolls 12 to the transfer station 4.

It will be appreciated that the process described above for decreasing the buckle that has been formed in copy sheets can be applied at other locations in the copy sheet path of the printer and is not restricted to use at the registration rolls upstream of the image transfer station. It will also be understood that the described process is not applicable only to printers but could also be utilized in copiers.

We claim:

1. An electrostatographic reproducing machine comprising a circulating imaging member; a transfer station at which a developed toner image may be transferred from the imaging member to a copy sheet; a copy sheet path; and means for feeding copy sheets through the machine to receive a developed toner image at the transfer station; registration rolls which are located in the copy sheet path and which remain stationary while a copy sheet is received in the nip of the rolls and a buckle forms in the copy sheet as a result of being fed by said means for feeding the copy sheets; and means for driving the registration rolls to feed a copy sheet along the sheet path, the driving means being operable, when a copy sheet is registered in the nip of the registration rolls, initially to raise the speed of the rolls sufficiently to reduce the buckle in the sheet and then to reduce the speed to continue feeding the sheet along the copy sheet path.

2. A machine as claimed in claim 1, in which the registration rolls are positioned to feed copy sheets to the transfer station and the reduced speed of the rolls is approximately equal to that of the imaging member.

3. A machine as claimed in claim 1, wherein the buckle-reducing speed of the rolls is about 20% greater than the reduced speed.

4. A machine as claimed in claim 2, wherein the buckle-reducing speed of the rolls is about 20% greater than the reduced speed.

5. A machine as claimed in claim 1, wherein the rolls are run at the buckle-reducing speed to reduce the buckle in the copy sheet by about one quarter.

6. A machine as claimed in claim 1, wherein the length of time for which the rolls are run at the buckle-reducing speed is adjustable.

7. A machine as claimed in claim 5 wherein the driving means for the registration rolls is a stepper motor.

8. A method of producing copies using an electrostatographic reproducing machine comprising the steps of; providing a circulating imaging member; providing a transfer station at which a developed toner image may be transferred from the imaging member to a copy sheet; providing a copy sheet path along which copy sheets may be fed through the machine to receive a developed toner image at the transfer station; providing registration rolls which are located in the copy sheet path;

maintaining the registration rolls stationary while a copy sheet is received in the nip of the rolls and a buckle forms in the copy sheet and, when the copy sheet is registered in the nip of the registration rolls, raising the speed of the rolls sufficiently to reduce the buckle in the sheet and then reducing the speed to continue feeding the sheet along the copy sheet path.

* * * * *